US010565907B1

(12) United States Patent
Trifone

(10) Patent No.: US 10,565,907 B1
(45) Date of Patent: Feb. 18, 2020

(54) RETRACTABLE REALTOR DISPLAY SIGN

(71) Applicant: Rich Trifone, Worcester, MA (US)

(72) Inventor: Rich Trifone, Worcester, MA (US)

( * ) Notice: Subject to any disclaimer, the term of this patent is extended or adjusted under 35 U.S.C. 154(b) by 0 days.

(21) Appl. No.: 16/423,260

(22) Filed: May 28, 2019

(51) Int. Cl.
*G09F 15/00* (2006.01)

(52) U.S. Cl.
CPC ..... *G09F 15/0062* (2013.01); *G09F 15/0037* (2013.01); *G09F 15/005* (2013.01); *G09F 15/0025* (2013.01)

(58) Field of Classification Search
CPC ..... G09F 15/0062; G09F 15/0037; G09F 15/0025; G09F 15/005; G09F 15/0087; A47G 5/02
See application file for complete search history.

(56) References Cited

U.S. PATENT DOCUMENTS 1,576,840 A * 3/1926 Meyer ..... G09B 29/06 40/517
5,097,611 A * 3/1992 Smollar ..... G09F 11/29 160/24
D339,168 S 9/1993 Gerhart
6,266,904 B1 * 7/2001 Zheng ..... G09F 15/0037 116/173
6,643,966 B2 11/2003 Schmitt
6,684,541 B2 * 2/2004 McPhaul ..... G09F 11/18 160/301
6,698,122 B1 * 3/2004 Merenlender ..... G09F 13/04 40/572
7,337,567 B2 3/2008 Fritsche
7,389,603 B1 * 6/2008 Brumfield ..... A45F 3/44 173/91
7,716,860 B1 * 5/2010 Burris ..... G09F 11/29 160/23.1
D616,944 S * 6/2010 Taylor ..... G09F 15/0025 D20/10
8,006,420 B2 8/2011 Merner
9,098,241 B1 * 8/2015 Cho ..... H05K 1/028
2002/0050083 A1 * 5/2002 Zarelius ..... G09F 11/18 40/514
2002/0121034 A1 * 9/2002 Schmitt ..... G09F 15/0025 40/604
2004/0055976 A1 * 3/2004 Dawson ..... E06B 9/40 211/45
2004/0244249 A1 * 12/2004 Zheng ..... G09F 15/00 40/610
2005/0028943 A1 * 2/2005 Chang ..... E06B 9/42 160/23.1
2005/0081413 A1 4/2005 Ko
(Continued)

*Primary Examiner* — Gary C Hoge

(57) ABSTRACT

The retractable realtor display sign displays an image. The image comprises indicia that symbolize a sentiment. The retractable realtor display sign comprises a mesh screen, a scroll apparatus, a free sleeve, a deployment apparatus, and a display structure selected from a plurality of display structures. The mesh screen attaches to the scroll apparatus. The free sleeve attaches to the mesh screen. The deployment apparatus secures the free sleeve to a display structure selected from the plurality of display structures. Each of the plurality of display structures is a pedestal that transfers the load path of the balance of the retractable realtor display sign to a supporting surface. The scroll apparatus stores the mesh screen such that the mesh screen deploys for display and retracts for storage.

16 Claims, 5 Drawing Sheets

(56) References Cited

U.S. PATENT DOCUMENTS

2005/0166430 A1* 8/2005 Zarelius ..... G09F 15/0025 40/600
2007/0107286 A1* 5/2007 Jedlicka ..... E04H 15/40 40/610
2007/0209261 A1 9/2007 Stover
2008/0148613 A1* 6/2008 Lefebvre ..... G09F 7/00 40/601
2009/0056184 A1* 3/2009 Fritsche ..... G09F 15/0025 40/604
2010/0038042 A1 2/2010 Criss
2010/0050489 A1* 3/2010 Merner ..... G09F 15/0025 40/604
2010/0058634 A1* 3/2010 Elliott ..... G09F 15/0025 40/606.12
2010/0146832 A1* 6/2010 Gimpel ..... G09F 11/21 40/604
2010/0180481 A1* 7/2010 Parizek ..... G09F 11/30 40/610
2012/0002357 A1* 1/2012 Auld ..... G09F 9/33 361/679.01
2012/0073170 A1* 3/2012 Boltz ..... G09F 15/0025 40/603
2013/0016497 A1* 1/2013 Anderson ..... G09F 9/301 362/97.1
2014/0053436 A1* 2/2014 English ..... G09F 15/0025 40/541
2014/0268532 A1* 9/2014 Nicol ..... G09F 9/301 361/679.26
2016/0163242 A1* 6/2016 Lee ..... G09F 9/301 40/584
2016/0335931 A1* 11/2016 Dalton ..... G09F 15/0087
2016/0363960 A1* 12/2016 Park ..... G06F 1/1656
2017/0162085 A1* 6/2017 Ellingson ..... G09F 7/22
2018/0182269 A1* 6/2018 Veazie, IV ..... G09F 17/00

* cited by examiner

RETRACTABLE REALTOR DISPLAY SIGN

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of physics and instruments including signs and displays, more specifically, a planar structure for notices comprising one or more panels. (G09F15/0006)

SUMMARY OF INVENTION

The retractable realtor display sign displays an image. The image comprises indicia that symbolize a sentiment. The retractable realtor display sign comprises a mesh screen, a scroll apparatus, a free sleeve, a deployment apparatus, and a display structure selected from a plurality of display structures. The mesh screen attaches to the scroll apparatus. The free sleeve attaches to the mesh screen. The deployment apparatus secures the free sleeve to a display structure selected from the plurality of display structures. Each of the plurality of display structures is a pedestal that transfers the load path of the balance of the retractable realtor display sign to a supporting surface. The scroll apparatus stores the mesh screen such that the mesh screen deploys for display and retracts for storage.

These together with additional objects, features and advantages of the retractable realtor display sign will be readily apparent to those of ordinary skill in the art upon reading the following detailed description of the presently preferred, but nonetheless illustrative, embodiments when taken in conjunction with the accompanying drawings.

In this respect, before explaining the current embodiments of the retractable realtor display sign in detail, it is to be understood that the retractable realtor display sign is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the retractable realtor display sign.

It is therefore important that the claims be regarded as including such equivalent construction insofar as they do not depart from the spirit and scope of the retractable realtor display sign. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
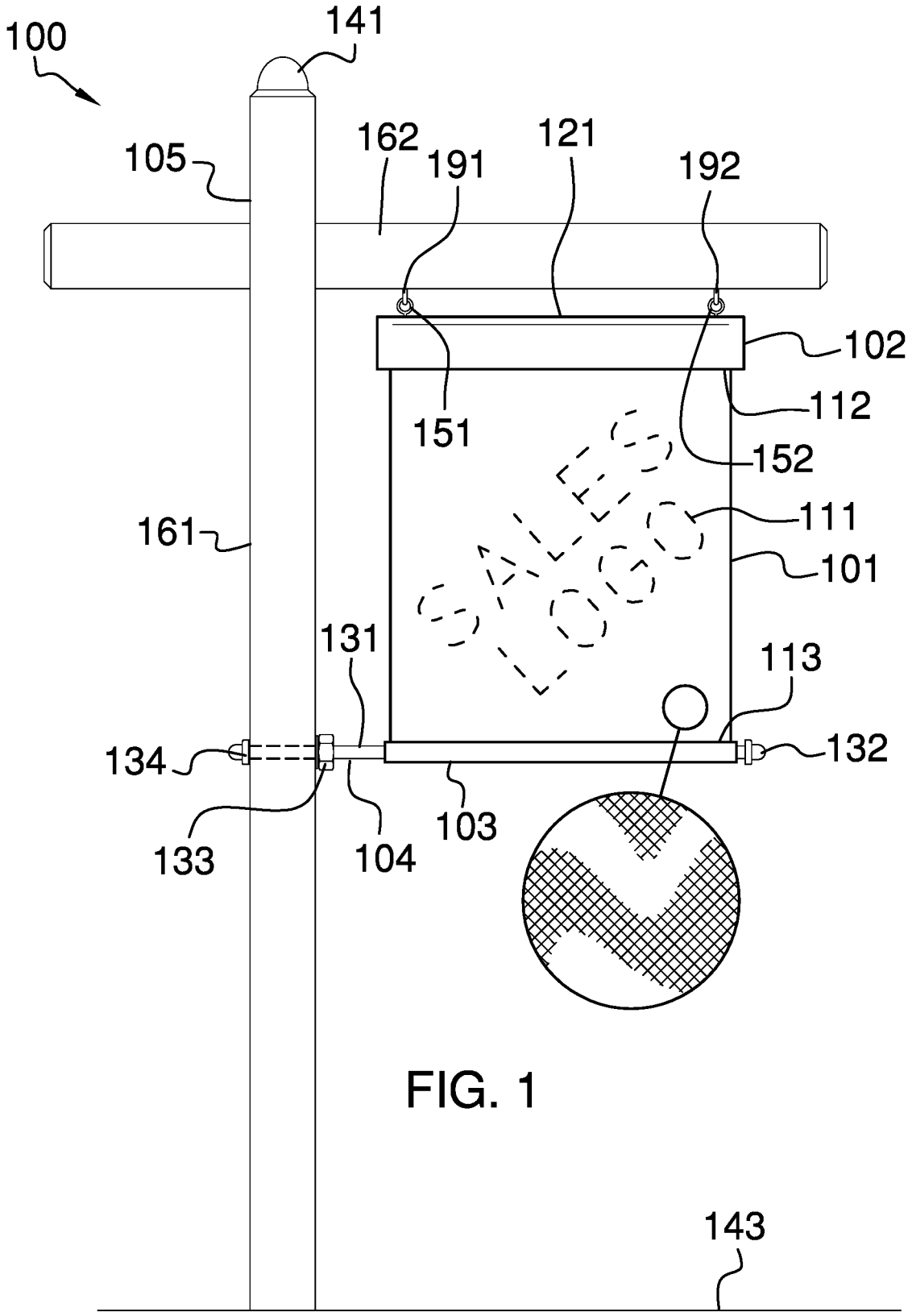
FIG. 1 is a front view of an embodiment of the disclosure.
Figure 2:
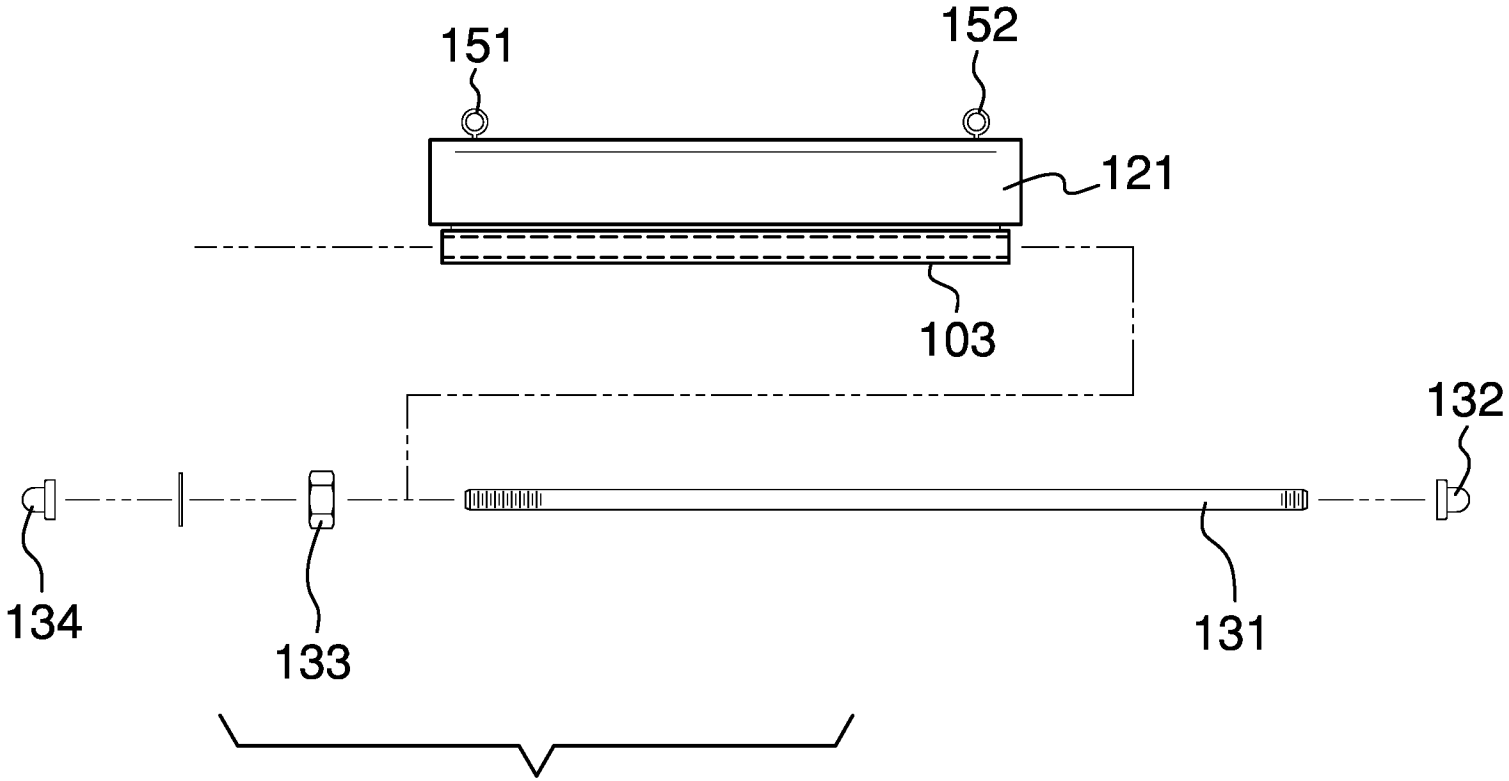
FIG. 2 is an exploded view of an embodiment of the disclosure.
Figure 3:
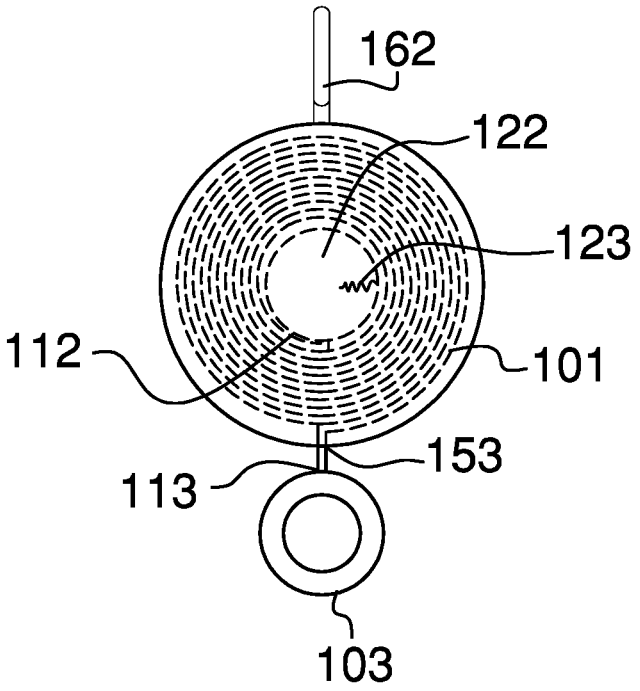
FIG. 3 is a side view of an embodiment of the disclosure.
Figure 4:
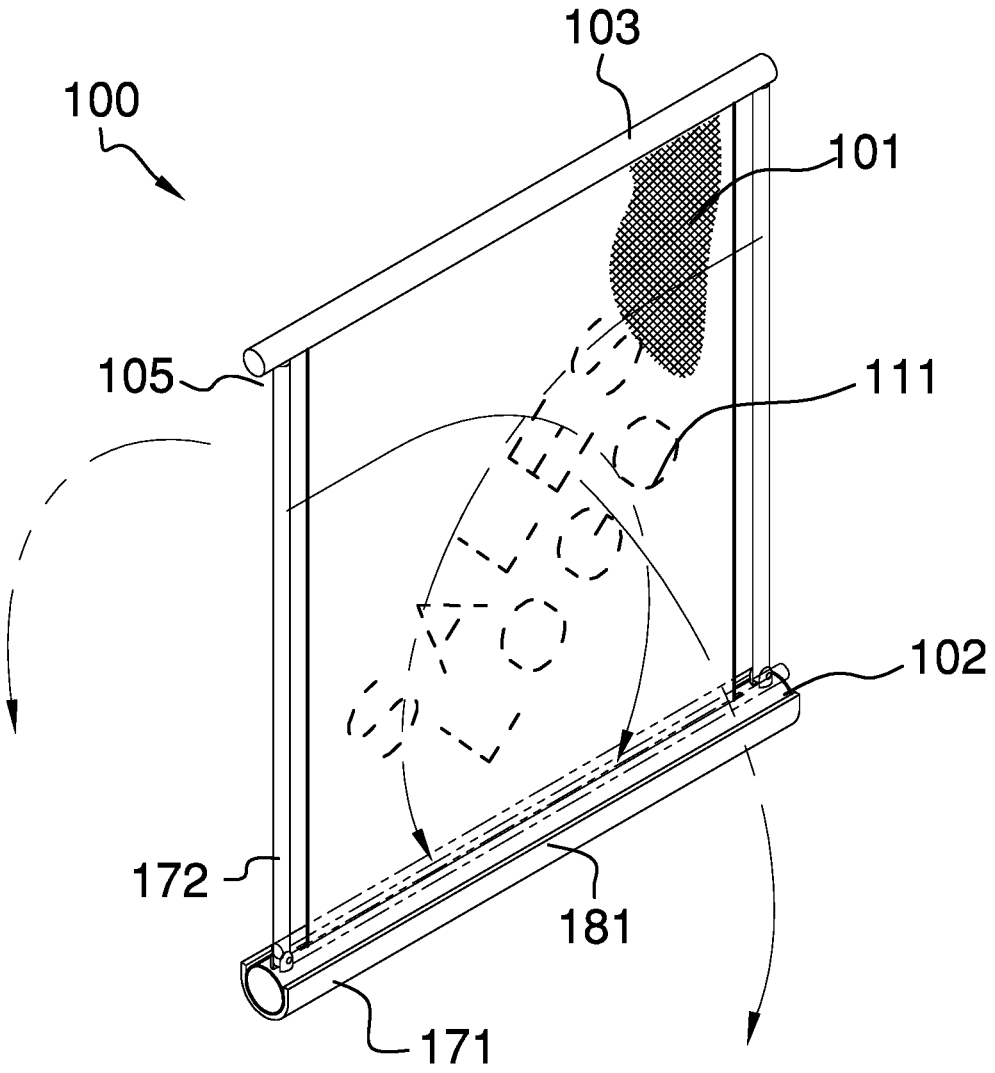
FIG. 4 is an in-use view of an embodiment of the disclosure.
Figure 5:
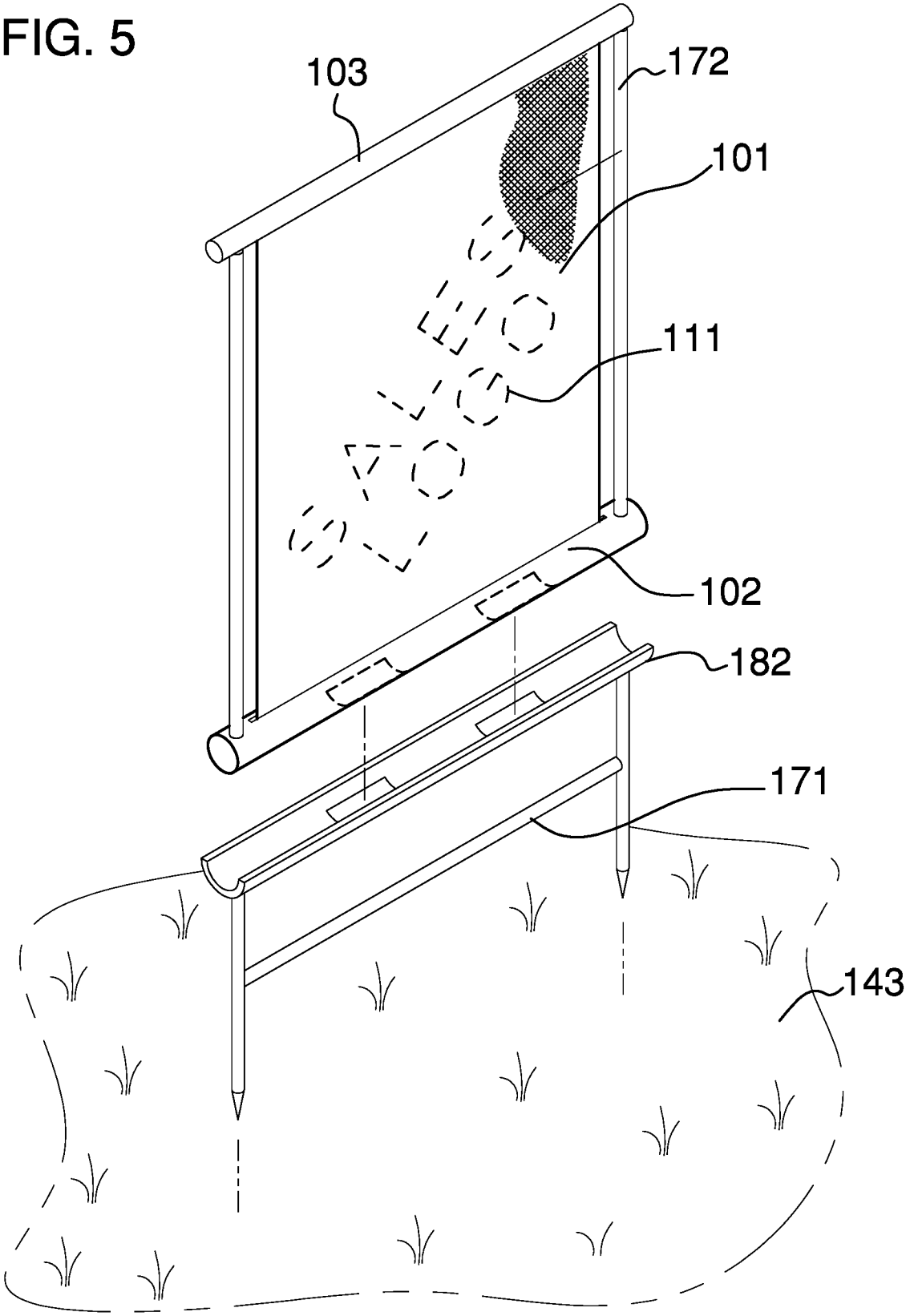
FIG. 5 is an in-use view of an embodiment of the disclosure.

Detailed reference will now be made to one or more potential embodiments of the disclosure, which are illustrated in FIGS. 1 through 5.

The retractable realtor display sign 100 (hereinafter invention) displays an image 111. The image 111 comprises indicia that symbolize a sentiment. The invention 100 comprises a mesh screen 101, a scroll apparatus 102, a free sleeve 103, a deployment apparatus 104, and a display structure selected from a plurality of display structures 105. The mesh screen 101 attaches to the scroll apparatus 102. The free sleeve 103 attaches to the mesh screen 101. The deployment apparatus 104 secures the free sleeve 103 to a display structure selected from the plurality of display structures 105. Each of the plurality of display structures 105 is a pedestal that transfers the load path of the balance of the invention 100 to a supporting surface 143. The scroll apparatus 102 stores the mesh screen 101 such that the mesh screen 101 deploys for display and retracts for storage.

The mesh screen 101 is a textile sheeting. The mesh screen 101 is a flexible structure. The mesh screen 101 has a rectangular shape. The mesh screen 101 is a mesh sheeting. The mesh size of the mesh screen 101 is selected such that wind will pass through the mesh screen 101. The mesh screen 101 has a printed image 111 that displays a sentiment. The mesh screen 101 is deployed from and retracts into the scroll apparatus 102. The mesh screen 101 comprises an image 111, a fixed end 112, and a free end 113.

The image 111 is a collection of indicia that are printed on the mesh screen 101. The indicia presented by the image 111 symbolize a sentiment. The intent of the image 111 is to communicate the sentiment. The fixed end 112 is an edge of the mesh screen 101. The fixed end 112 attaches to the scroll apparatus 102 such that the mesh screen 101 does not detach from the scroll apparatus 102. The free end 113 is the edge of the mesh screen 101 that is distal from the fixed end 112.

The scroll apparatus 102 is a hollow prism-shaped structure. The scroll apparatus 102 stores the mesh screen 101 as a scroll when the mesh screen 101 is not on display. The scroll apparatus 102 contains the mechanical devices required to deploy and retract the mesh screen 101. The scroll apparatus 102 attaches to a display structure selected from the plurality of display structures 105. The fixed end 112 of the mesh screen 101 attaches to the scroll apparatus 102. The scroll apparatus 102 comprises a mantle 121, a storage dowel 122, and a roller clutch and spring system 123.

The mantle 121 is a hollow prism-shaped structure. The mantle 121 contains the storage dowel 122, the roller clutch and spring system 123, and the mesh screen 101. The mantle 121 further comprises a first suspending loop 151, a second suspending loop 152, and an access slot 153.

The first suspending loop 151 is a ring that attaches to the exterior surface of the lateral face of the prism structure of the mantle 121. The first suspending loop 151 allows for the suspension of the scroll apparatus 102 from a display structure selected from the plurality of display structures 105.

The second suspending loop 152 is a ring that attaches to the exterior surface of the lateral face of the prism structure of the mantle 121. The second suspending loop 152 allows for the suspension of the scroll apparatus 102 from a display structure selected from the plurality of display structures 105.

The access slot 153 is a roughly rectangular aperture formed through the lateral face of the mantle 121. The major axis of the access slot 153 is parallel to the center axis of the mantle 121. The mesh screen 101 is retracted into and deployed from the scroll apparatus 102 through the access slot 153.

The storage dowel 122 is a prism-shaped structure. The storage dowel 122 has a cylindrical shape. The storage dowel 122 is a rotating structure. The storage dowel 122 rotates around an axis of rotation aligned with the center axis of the prism structure of the storage dowel 122. The mesh screen 101 retracts onto the storage dowel 122 such that the mesh screen 101 is stored as a scroll on the storage dowel 122 within the mantle 121.

The roller clutch and spring system 123 is a mechanical device. The roller clutch and spring system 123 mechanically assists in the deployment of the mesh screen 101 from the storage dowel 122. The roller clutch and spring system 123 mechanically assists in the retraction of the mesh screen 101 from the storage dowel 122. The roller clutch and spring system 123 acts as a ratchet that prevents the mesh screen 101 from being withdrawn back into the mantle 121 as the mesh screen 101 during deployment. The roller clutch and spring system 123 acts as a spring-loaded mechanism that reverses the rotation of the storage dowel 122 such that the mesh screen 101 retracts into the mantle 121 and on to the storage dowel 122. The roller clutch and spring system 123 is defined in greater detail elsewhere in this disclosure.

The free sleeve 103 is a hollow prism-shaped structure. The free sleeve 103 is formed with a solid lateral face and two open congruent ends. The free end 113 of the mesh screen 101 attaches to the lateral face of the free sleeve 103. The free sleeve 103 forms a spacer that is used by the deployment apparatus 104 to attach the free end 113 of the mesh screen 101 to a display structure selected from the plurality of display structures 105. The free sleeve 103 further forms a handle used to deploy and retract the mesh screen 101. The free sleeve 103 attaches to the free end 113 of the mesh screen 101.

The deployment apparatus 104 is a mechanical structure. The deployment apparatus 104 attaches the free sleeve 103 to the display structure selected from the plurality of display structures 105 such that the mesh screen 101 will not move freely relative to the display structure selected from the plurality of display structures 105 in windy conditions. The deployment apparatus 104 comprises a bolt 131, a Keter 132, a set nut 133, and a tightening nut 134.

The bolt 131 is a cylindrical structure. The bolt 131 is further formed with an exterior screw thread. The bolt 131 inserts through the hollow spacer structure formed in the free sleeve 103. The bolt 131 attaches the free sleeve 103 to the display structure selected from the plurality of display structures 105.

The Keter 132 is a capped tube structure. The Keter 132 forms a nut structure that screws onto the bolt 131. The Keter 132 attaches to the bolt 131 such that the free sleeve 103 will not slide off of the bolt 131. The set nut 133 is a nut that screws onto the bolt 131. The set nut 133 forms a barrier that fixes the position of the bolt 131 relative to the display structure selected from the plurality of display structures 105. The set nut 133 is positioned on the lateral face of the bolt 131. The tightening nut 134 is a nut that screws onto the bolt 131. The tightening nut 134 tightens the deployment apparatus 104 to the display structure selected from the plurality of display structures 105.

Each display structure selected from the plurality of display structures 105 creates a load path the transfers the combined loads of the mesh screen 101, the scroll apparatus 102, the free sleeve 103, and the deployment apparatus 104 to a supporting surface 143. Each display structure selected from the plurality of display structures 105 holds the mesh screen 101 at a position elevated above the supporting surface 143. The display structure selected from the plurality of display structures 105 is selected from the group consisting of a suspension structure 141 and a ground structure 142.

The suspension structure 141 is a mechanical structure that suspends the mesh screen 101, the scroll apparatus 102, and the free sleeve 103 above the supporting surface 143. The suspension structure 141 transfers the load of the mesh screen 101, the scroll apparatus 102, the free sleeve 103, and the deployment apparatus 104 to the supporting surface 143. The suspension structure 141 comprises a stanchion 161 and a jib 162.

The stanchion 161 is a vertically oriented post that is driven into the supporting surface 143. The stanchion 161 is an extension structure that separates the jib 162 from the supporting surface 143. The bolt 131 of the deployment apparatus 104 inserts through the stanchion 161 of the suspension structure 141. The jib 162 is a horizontally oriented beam that attaches to the stanchion 161 in the manner of a cantilever. The jib 162 suspends the mantle 121 of the scroll apparatus 102 above the supporting surface 143.

The jib 162 further comprises a first hook 191 and a second hook 192. The first hook 191 is a hardware item that attaches to the lateral face of the jib 162. The first hook 191 attaches to the first suspending loop 151 of the mantle 121 to suspend the mantle 121 above the supporting surface 143. The second hook 192 is a hardware item that attaches to the lateral face of the jib 162. The second hook 192 attaches to the second suspending loop 152 of the mantle 121 to suspend the mantle 121 above the supporting surface 143.

The ground structure 142 is a pedestal structure that forms a load path that transfers the loads of the mesh screen 101, the scroll apparatus 102, and the free sleeve 103 above the supporting surface 143. The ground structure 142 transfers the load of the mesh screen 101, the scroll apparatus 102, the free sleeve 103, and the deployment apparatus 104 to the supporting surface 143. The ground structure 142 comprises a base structure 171 and a hyoid structure 172.

The base structure 171 of the ground structure 142 is the portion of the ground structure 142 that rests on the supporting surface 143. The mantle 121 attaches to the base structure 171. The hyoid structure 172 is a hyoid shaped telescopic structure. The crossbeam of the hyoid structure 172 is formed from the deployment apparatus 104 such that the free sleeve 103 is suspended above the scroll apparatus 102 by the hyoid structure 172. The arms of the hyoid structure 172 are telescopic such that the elevation of the free sleeve 103 is adjustable.

The base structure 171 is selected from the group consisting of a roller base 181 and a stake structure 182. The roller base 181 is formed as a horizontal segment of a hollow cylindrical structure. Both congruent ends of the hollow cylindrical structure are open. The span of the inner diameter of the roller base 181 is greater than the span of the outer dimension of the mantle 121 such that the mantle 121 will insert into the roller base 181. The roller base 181 is weighted such that the roller base 181 will rotate when the mesh screen 101 is subjected to a heavy wind. The stake structure 182 is comprises a plurality of stakes. Each stake selected from the plurality of stakes attach to the free end of an arm of the hyoid structure 172. The stake structure 182 is driven into the supporting surface 143.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Bolt: As used in this disclosure, a bolt is a cylindrical shaft that is formed with an exterior screw thread. A bolt is defined with an outer diameter.

Cantilever: As used in this disclosure, a cantilever is a beam or other structure that projects away from an object and is supported on only one end. A cantilever is further defined with a fixed end and a free end. The fixed end is the end of the cantilever that is attached to the object. The free end is the end of the cantilever that is distal from the fixed end.

Capped Tube: As used in this disclosure, a capped tube is a tube with one closed end and one open end.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Center of Rotation: As used in this disclosure, the center of rotation is the point of a rotating plane that does not move with the rotation of the plane. A line within a rotating three-dimensional object that does not move with the rotation of the object is also referred to as an axis of rotation.

Clutch: As used in this disclosure, a clutch is a mechanical device that attaches and detaches a first rotating device to and from a second device that provides the energy required to rotate the first rotating device.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Correspond: As used in this disclosure, the term correspond is used as a comparison between two or more objects wherein one or more properties shared by the two or more objects match, agree, or align within acceptable manufacturing tolerances.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Elevation: As used in this disclosure, elevation refers to the span of the distance in the superior direction between a specified horizontal surface and a reference horizontal surface. Unless the context of the disclosure suggest otherwise, the specified horizontal surface is the supporting surface the potential embodiment of the disclosure rests on. The infinitive form of elevation is to elevate.

Extension Structure: As used in this disclosure, an extension structure is an inert physical structure that is used to extend or bridge the reach between any two objects.

Exterior Screw Thread: An exterior screw thread is a ridge wrapped around the outer surface of a tube in the form of a helical structure that is used to convert rotational movement into linear movement.

Flexible: As used in this disclosure, flexible refers to an object or material that will deform when a force is applied to it but that will not necessarily return to its original shape when the deforming force is removed.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Hook: As used in this disclosure, a hook is an object that is curved or bent at an angle such that items can be hung on or caught by the object.

Horizontal Segment: As used in this disclosure, a horizontal segment refers to a prism or cylinder that is bifurcated by a single plane that is parallel to or contains the center axis of the prism or cylinder.

Hyoid: As used in this disclosure, a hyoid refers to a three-sided structure comprising a crossbeam, a first arm, and a second arm. In a hyoid, the first arm and the second arm project away from the crossbeam: 1) in the same direction; 2) at a roughly perpendicular angle to the crossbeam, and, 3) the span of the length of the first arm roughly equals the span of the length of the second arm. Hyoids generally have a U shaped appearance.

Image: As used in this disclosure, an image is an optical representation or reproduction of an indicia or of the appearance of something or someone.

Indicia: As used in this disclosure, the term indicia refers to a set of markings that identify a sentiment.

Inferior: As used in this disclosure, the term inferior refers to a directional reference that is parallel to and in the same direction as the force of gravity when an object is positioned or used normally.

Inner Dimension: As used in this disclosure, the term inner dimension describes the span from a first inside or interior surface of a container to a second inside or interior surface of a container. The term is used in much the same way that a plumber would refer to the inner diameter of a pipe.

Interior Screw Thread: An interior screw thread is a groove that is formed around the inner surface of a tube in the form of a helical structure that is used to convert rotational movement into linear movement.

Jib: As used in this disclosure, a jib is a beam structure that: 1) is mounted with a free end in the manner of a cantilever; and, 2) suspends a load at the free end of the jib. In multicomponent beam structures, such as with a crane, the jib is the sub-structure that physically suspends the load.

Keter: As used in this disclosure, a Keter is an end piece that attaches to one of the congruent ends of a prism-shaped structure.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

Major and Minor Axes: As used in this disclosure, the major and minor axes refer to a pair of perpendicular axes that are defined within a structure. The length of the major axis is always greater than or equal to the length of the minor axis. The major axis is always the longest diameter of the structure. The major and minor axes intersect at the center of the structure. The major axis is always parallel to an edge of a rectangular or rectilinear structure.

Mesh: As used in this disclosure, the term mesh refers to an openwork fabric made from threads, yarns, cords, wires, or lines that are woven, knotted, or otherwise twisted or intertwined at regular intervals. Synonyms for mesh include net. A mesh structure formed from metal bars or wires is often referred to as a grate.

Nut: As used in this disclosure, a nut is a first object that is formed with a cylindrical negative space that further comprises an interior screw thread such that a second object with a matching exterior screw thread can screw into the first object forming a threaded connection. A nut is further defined with an inner diameter.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Outer Dimension: As used in this disclosure, the term outer dimension describes the span from a first exterior or outer surface of a tube or container to a second exterior or outer surface of a tube or container. The term is used in much the same way that a plumber would refer to the outer diameter of a pipe.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Ratchet: As used in this disclosure, a ratchet is a device comprising a pawl or hinged catch that engages the sloping teeth of a wheel or bar permitting motion in one direction only.

Ring: As used in this disclosure, a ring is a term that is used to describe a flat or plate-like structure through which an aperture is formed. Rings are often considered loops.

Roller Clutch and Spring System: As used in this disclosure, a roller clutch and spring system is a commercially available system for storing a sheeting on a scroll. The sheeting is stored on a rotating cylindrical roller as the scroll. The clutch portion of the roller clutch and spring system is configured to allow the rotating cylindrical roller to rotate in a first direction. The spring portion of the roller clutch and spring system is configured to return the rotating cylindrical roller to its original position when the clutch portion is released. A common example of the roller clutch and spring system is the mechanism used to raise and lower window blinds.

Screen: As used in this disclosure, a screen is a meshed structure made of wire, yarn, or cloth that allows for the free flow of air but prevents larger objects from passing through the meshed structure.

Screw: As used in this disclosure, to screw is a verb meaning: 1) to fasten or unfasten (unscrew) a threaded connection; or 2) to attach a helical structure to a solid structure.

Scroll: As used in this disclosure, a scroll is a sheeting that is stored as a roll.

Sentiment: As used in this disclosure, a sentiment refers to a symbolic meaning or message that is communicated through the use of an image, potentially including a text-based image.

Sheeting: As used in this disclosure, a sheeting is a material, such as a paper, textile, a plastic, or a metal foil, in the form of a thin flexible layer or layers.

Slot: As used in this disclosure, a slot is a long narrow cut or opening that is formed in or through an object.

Spacer: As used in this disclosure, a spacer is a hollow prism-shaped structure that is formed with a cylindrical negative space that allows a shaft to be inserted through the congruent ends of the prism-shaped structure. A spacer typically is configured to receive a bolt. A spacer is further defined with an inner diameter.

Spring: As used in this disclosure, a spring is a device that is used to store mechanical energy. This mechanical energy will often be stored by: 1) deforming an elastomeric material that is used to make the device; 2) the application of a torque to a semi-rigid structure; or 3) a combination of the previous two items.

Stake: As used in this disclosure, a stake is a shaft that is driven into a horizontal surface, such as the ground, to serve as an anchor point.

Stanchion: As used in this disclosure, a stanchion refers to a vertical pole, post, or support. See beam and gusset and strut.

Superior: As used in this disclosure, the term superior refers to a directional reference that is parallel to and in the opposite direction of the force of gravity when an object is positioned or used normally.

Suspend: As used in this disclosure, to suspend an object means to support an object such that the inferior end of the object does not form a significant portion of the load path of the object.

Telescopic: As used in this disclosure, telescopic is an adjective that describes an object made of sections that fit or slide into each other such that the object can be made longer or shorter by adjusting the relative positions of the sections.

Textile: As used in this disclosure, a textile is a material that is woven, knitted, braided or felted. Synonyms in common usage for this definition include fabric and cloth.

Threaded Connection: As used in this disclosure, a threaded connection is a type of fastener that is used to join a first cylindrical object and a second cylindrical object together. The first cylindrical object is fitted with a first fitting selected from an interior screw thread or an exterior screw thread. The second cylindrical object is fitted with the remaining screw thread. The cylindrical object fitted with the exterior screw thread is placed into the remaining cylindrical object such that: 1) the interior screw thread and the exterior screw thread interconnect; and, 2) when the cylindrical object fitted with the exterior screw thread is rotated the rotational motion is converted into linear motion that moves the cylindrical object fitted with the exterior screw thread either into or out of the remaining cylindrical object. The direction of linear motion is determined by the direction of rotation.

Tube: As used in this disclosure, the term tube is used to describe a rigid hollow prism with two open ends. While tubes that are suitable for use in this disclosure are often used to transport or conveys fluids or gases, the purpose of the tubes in this disclosure are structural. In this disclosure, the terms inner dimension and outer dimension of a tube are used as they would be used by those skilled in the plumbing arts.

Wind: As used in this disclosure, wind refers to the movement of atmospheric gases in a single direction.

With respect to the above description, it is to be realized that the optimum dimensional relationship for the various components of the invention described above and in FIGS. 1 through 5 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A realtor display sign comprising:

a mesh screen, a scroll apparatus, a free sleeve, a deployment apparatus, and a display structure selected from a plurality of display structures;

wherein the mesh screen attaches to the scroll apparatus;

wherein the free sleeve attaches to the mesh screen;

wherein the deployment apparatus secures the free sleeve to the display structure selected from the plurality of display structures;

wherein the realtor display sign displays an image;

wherein the image comprises indicia that symbolize a sentiment;

wherein the scroll apparatus comprises a mantle, a storage dowel, and a roller clutch and spring system;

wherein the mantle contains the storage dowel, the roller clutch and spring system, and the mesh screen;

wherein the roller clutch and spring system is a mechanical device;

wherein the roller clutch and spring system mechanically assists in the deployment of the mesh screen from the storage dowel;

wherein the roller clutch and spring system mechanically assists in the retraction of the mesh screen from the storage dowel;

wherein the roller clutch and spring system forms a ratchet that prevents the mesh screen from being withdrawn back into the mantle as the mesh screen during deployment;

wherein the roller clutch and spring system forms a spring-loaded mechanism that reverses the rotation of the storage dowel such that the mesh screen retracts into the mantle and on to the storage dowel.

2. The realtor display sign according to claim 1 wherein the display structure selected from a plurality of display structures transfers the load path of the balance of the realtor display sign to a supporting surface.

3. The realtor display sign according to claim 2 wherein the scroll apparatus stores the mesh screen such that the mesh screen deploys for display;

wherein the scroll apparatus stores the mesh screen such that the mesh screen retracts for storage.

4. The realtor display sign according to claim 3 wherein the mesh screen is a textile sheeting;

wherein the mesh screen is a flexible structure;

wherein the mesh screen has a rectangular shape;

wherein the mesh screen is a mesh sheeting;

wherein the mesh size of the mesh screen is selected such that wind will pass through the mesh screen;

wherein the mesh screen displays the image.

5. The realtor display sign according to claim 4 wherein the scroll apparatus is a hollow prism-shaped structure;

wherein the scroll apparatus stores the mesh screen as a scroll;

wherein the scroll apparatus contains the mechanical devices required to deploy and retract the mesh screen;

wherein the scroll apparatus attaches to the display structure selected from the plurality of display structures.

6. The realtor display sign according to claim 5 wherein the deployment apparatus is a mechanical structure;

wherein the deployment apparatus attaches the free sleeve to the display structure selected from the plurality of display structures.

7. The realtor display sign according to claim 6 wherein each display structure selected from the plurality of display structures creates a load path the transfers the combined loads of the mesh screen, the scroll apparatus, the free sleeve, and the deployment apparatus to a supporting surface;

wherein each display structure selected from the plurality of display structures holds the mesh screen at a position elevated above the supporting surface.

8. The realtor display sign according to claim 7 wherein the mesh screen comprises an image, a fixed end, and a free end;

wherein the fixed end is an edge of the mesh screen;

wherein the fixed end attaches to the scroll apparatus;

wherein the free end is the edge of the mesh screen that is distal from the fixed end.

9. The realtor display sign according to claim 8 wherein the mantle is a hollow prism-shaped structure.

10. The realtor display sign according to claim 9 wherein the mantle further comprises an access slot;

wherein the access slot is a roughly rectangular aperture formed through a lateral face of the mantle;

wherein a major axis of the access slot is parallel to a center axis of the mantle;

wherein the mesh screen is retracted into and deployed from the scroll apparatus through the access slot.

11. The realtor display sign according to claim 10 wherein the storage dowel is a prism-shaped structure;

wherein the storage dowel has a cylindrical shape;

wherein the storage dowel is a rotating structure;

wherein the storage dowel rotates around an axis of rotation aligned with the center axis of the prism structure of the storage dowel;

wherein the mesh screen retracts onto the storage dowel such that the mesh screen is stored as a scroll on the storage dowel within the mantle.

12. The realtor display sign according to claim 11 wherein the free sleeve is a hollow prism-shaped structure;

wherein the free sleeve is formed with a solid lateral face and two open congruent ends;

wherein the free end of the mesh screen attaches to the lateral face of the free sleeve;

wherein the free sleeve attaches to the free end of the mesh screen.

13. The realtor display sign according to claim 12 wherein the display structure selected from the plurality of display structures is selected from the group consisting of a suspension structure and a ground structure;

wherein the suspension structure is a mechanical structure that suspends the mesh screen, the scroll apparatus, and the free sleeve above the supporting surface;

wherein the suspension structure transfers the load of the mesh screen, the scroll apparatus, the free sleeve, and the deployment apparatus to the supporting surface;

wherein the ground structure is a pedestal structure that forms a load path that transfers the loads of the mesh screen, the scroll apparatus, and the free sleeve above the supporting surface;

wherein the ground structure transfers the load of the mesh screen, the scroll apparatus, the free sleeve, and the deployment apparatus to the supporting surface.

14. The realtor display sign according to claim 13 wherein the suspension structure comprises a stanchion and a jib;

wherein the stanchion is an extension structure that separates the jib from the supporting surface;

wherein the bolt of the deployment apparatus inserts through the stanchion of the suspension structure;

wherein the jib is a horizontally oriented beam that attaches to the stanchion in the manner of a cantilever;

wherein the jib suspends the mantle of the scroll apparatus above the supporting surface;

wherein the jib further comprises a first hook and a second hook;

wherein the first hook attaches to the lateral face of the jib;

wherein the first hook attaches to the first suspending loop of the mantle to suspend the mantle above the supporting surface;

wherein the second hook attaches to the lateral face of the jib;

wherein the second hook attaches to the second suspending loop of the mantle to suspend the mantle above the supporting surface.

15. The realtor display sign according to claim 13 wherein the ground structure comprises a base structure and a hyoid structure;

wherein the base structure of the ground structure is the portion of the ground structure that rests on the supporting surface;

wherein the mantle attaches to the base structure;

wherein the hyoid structure is a hyoid shaped telescopic structure;

wherein the hyoid structure comprises arms and a crossbeam;

wherein the crossbeam of the hyoid structure is formed from the deployment apparatus such that the free sleeve is suspended above the scroll apparatus by the hyoid structure;

wherein the arms of the hyoid structure are telescopic such that the elevation of the free sleeve is adjustable.

16. The realtor display sign according to claim 15 wherein the base structure is selected from the group consisting of a roller base and a stake structure;

wherein the roller base is formed as a horizontal segment of a hollow cylindrical structure;

wherein both congruent ends of the hollow cylindrical structure are open;

wherein the span of the inner diameter of the roller base is greater than the span of the outer dimension of the mantle such that the mantle will insert into the roller base;

wherein the roller base is weighted such that the roller base will rotate;

wherein the stake structure comprises a plurality of stakes that are attached to the hyoid structure;

wherein the stake structure is driven into the supporting surface.

* * * * *